United States Patent [19]

Hintsch

[11] Patent Number: 4,508,146

[45] Date of Patent: Apr. 2, 1985

[54] GRIPPER PROJECTILE FOR A WEAVING MACHINE

[75] Inventor: Otto Hintsch, Wallisellen, Switzerland

[73] Assignee: Sulzer Brothers Limited, Winterthur, Switzerland

[21] Appl. No.: 523,416

[22] Filed: Aug. 16, 1983

[30] Foreign Application Priority Data

Sep. 14, 1982 [CH] Switzerland ..... 5438/82

[51] Int. Cl.[3] ..... D03J 5/06

[52] U.S. Cl. ..... 139/196.2

[58] Field of Search ..... 139/196.1, 196.2, 196.3

[56] References Cited

U.S. PATENT DOCUMENTS 3,417,792 12/1968 Gurney ..... 139/196.2
3,695,306 10/1972 Kimura et al. ..... 139/196.2
4,120,329 10/1978 Hintsch et al. ..... 139/196.2

*Primary Examiner*—Henry S. Jaudon
*Attorney, Agent, or Firm*—Kenyon & Kenyon

[57] ABSTRACT

The gripper projectile is formed with a housing which is divided in the gripper plane so as to form two housing halves which are interconnected by rivets. The divided construction enables the gripper projectile to be manufactured by an inexpensive precision casting method or drop forging method.

19 Claims, 9 Drawing Figures

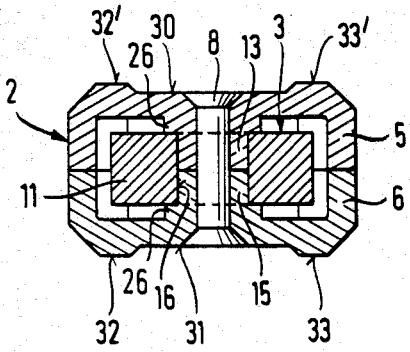
Fig. 3
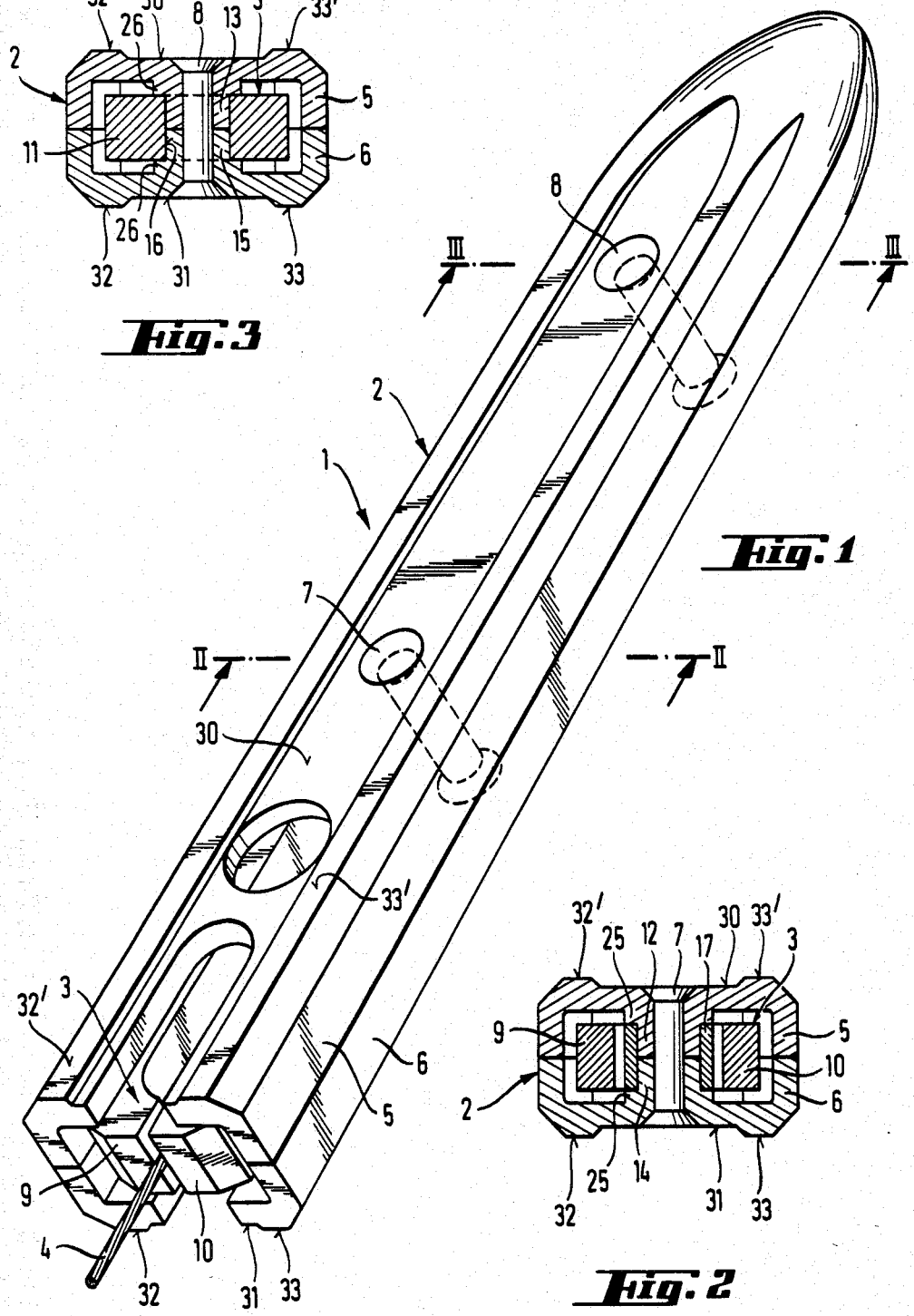
Fig. 1
Fig. 2

GRIPPER PROJECTILE FOR A WEAVING MACHINE

This invention relates to a gripper projectile for a weaving machine.

As is known, gripper projectiles are generally made in one piece. As such, the gripper projectiles have the disadvantage that manufacture is relatively expensive particularly since there is a need to form a cavity to accommodate a yarn gripper.

Accordingly, it is an object of the invention to provide a gripper projectile which can be manufactured in an inexpensive manner.

It is another object of the invention to provide a gripper projectile housing which can be manufactured using inexpensive precision casting techniques or drop forging techniques.

Briefly, the invention provides a gripper projectile for a weaving machine which is comprised of a gripper for gripping a weft yarn at one end and a housing for the gripper which is divided in a plane of the gripper so as to consist of two housing halves. In addition, the housing halves are connected together by means which pass through the housing and gripper, for example by fasteners in the form of rivets.

In one embodiment, in order to secure the housing halves together, each half is provided with a pair of hollow studs or pins which are aligned in abutted relation with a corresponding pair of hollow studs on the other housing half. In this case, the fasteners are passed through the studs to secure the housing halves together. In this embodiment, the gripper is constructed with a pair of limbs of resilient nature for engaging a weft yarn at one end and a yoke which secures the two limbs together. The yoke is further provided with an opening which is sized to fit about one aligned pair of hollow studs so as to contain the gripper within the housing.

In another embodiment, a pair of hollow studs pass through the yoke of the gripper while an oval-shaped stud on one housing half fits into a groove on the other housing half in mating relation. A fastener, such as a rivet also passes through the oval shaped stud to secure the housing halves together.

In order to damp out vibrations between the housing and the gripper, a suitable resilient member is disposed about the aligned studs between the gripper and housing.

Further, in order to reduce the weight of the gripper, the housing is recessed along the major side walls thereof as well as interiorly. Apertures may also be disposed in the major side walls along the length of the gripper housing.

These and other objects and advantages of the invention will become more apparent from the following detailed description taken in conjunction with the accompanying drawings wherein:

FIG. 1 illustrates a perspective view of a projectile constructed in accordance with the invention;

FIG. 2 illustrates a cross sectional view taken on line II—II of FIG. 2;

FIG. 3 illustrates a cross sectional view taken on line III—III of FIG. 1;

Figure 4B:
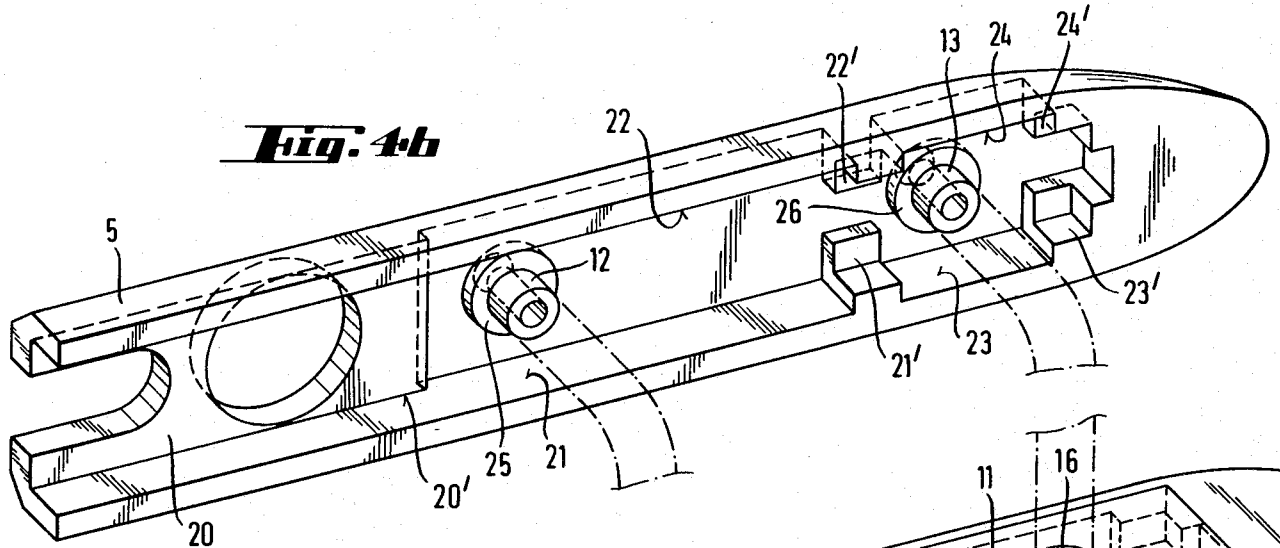
Figure 4A:
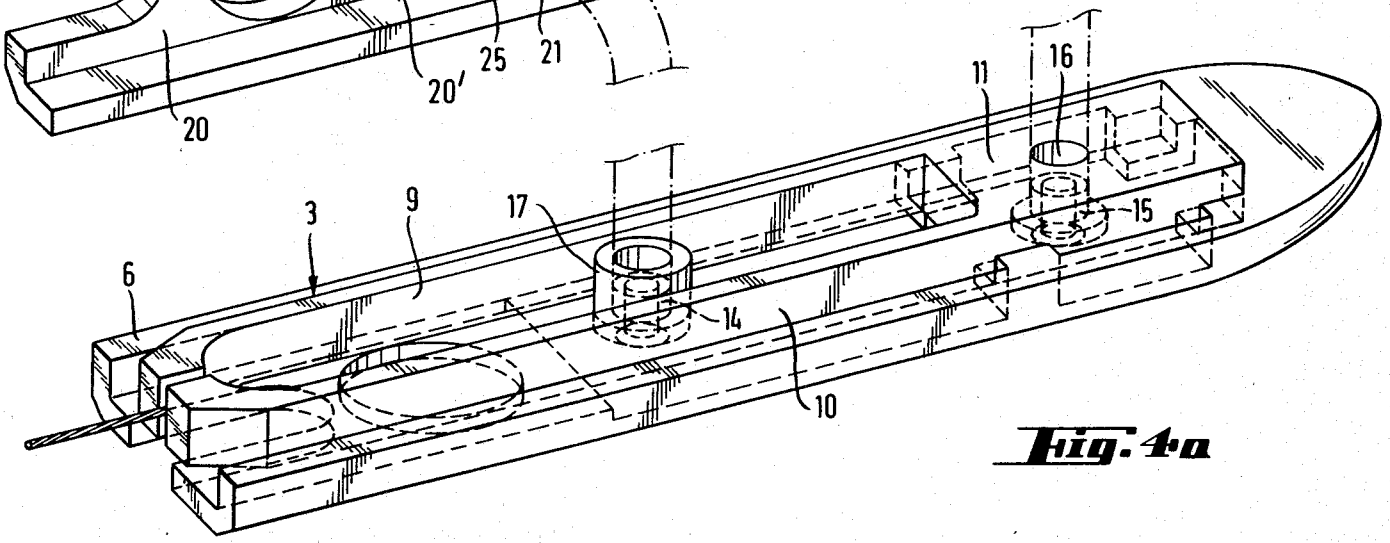
Figure 5B:
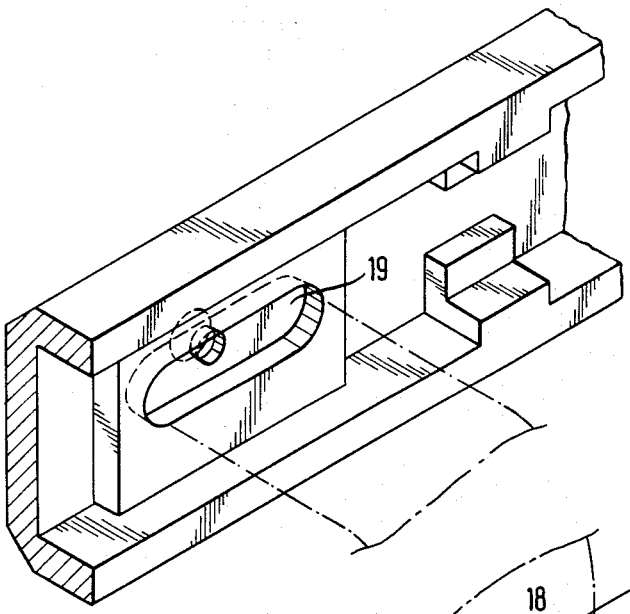
Figure 5A:
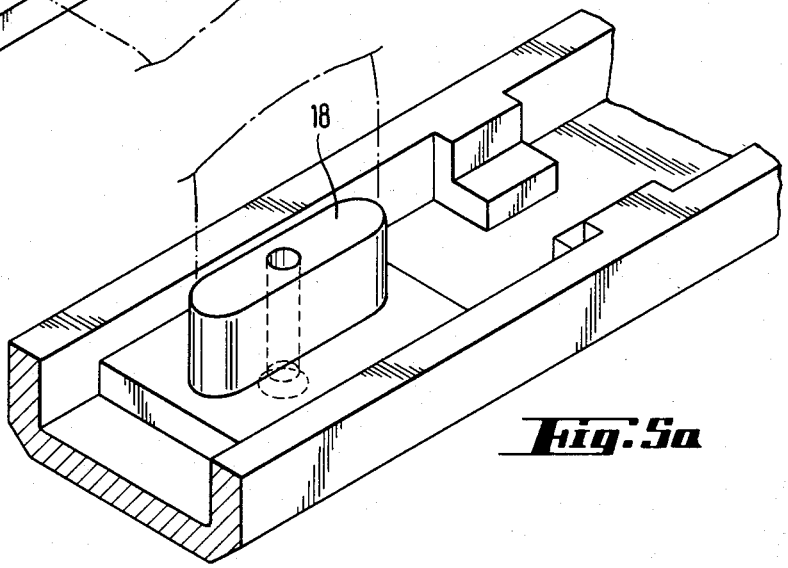

FIG. 4*a* illustrates a perspective view of one housing half of the projectile housing of FIG. 1;

FIG. 4*b* illustrates a perspective view of a second housing half of the projectile of FIG. 1;

FIG. 5*a* illustrates a part-perspective view of a modified housing half according to the invention;

FIG. 5*b* illustrates a part-perspective view of a mating housing half for the housing half of FIG. 5*a;*

Figure 6:
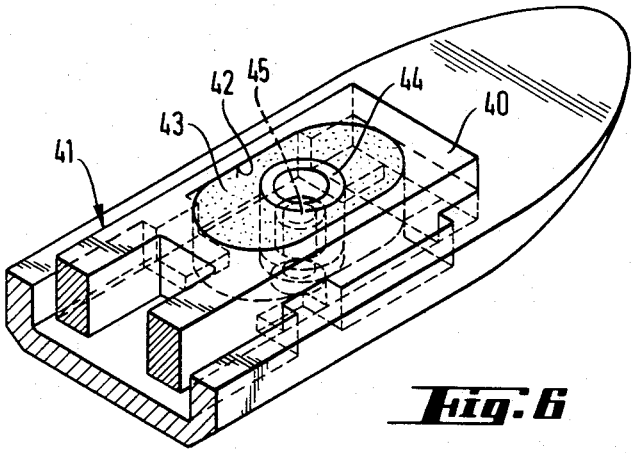
Figure 7:
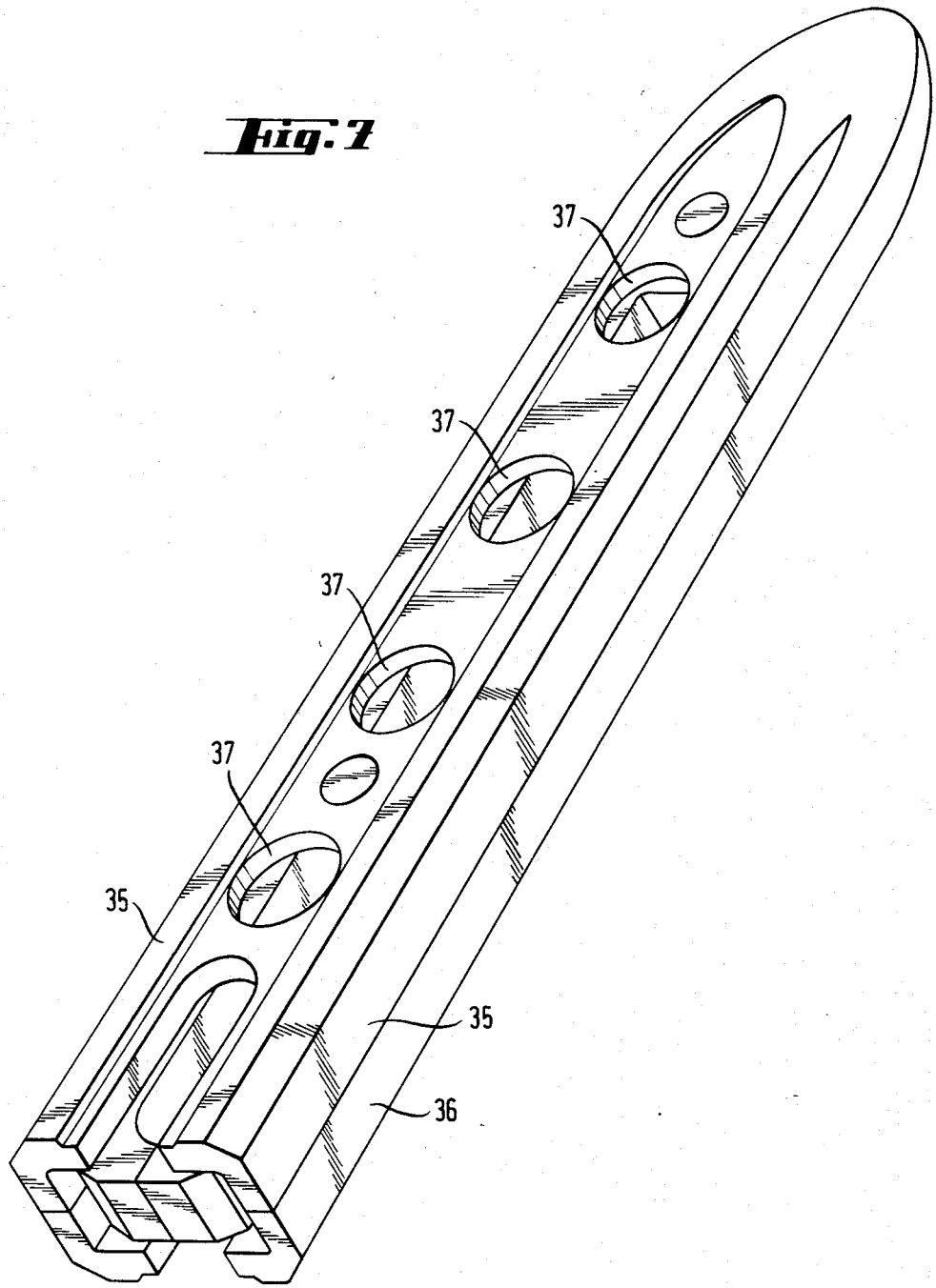

FIG. 6 illustrates a part perspective view of a projectile having a resilient member between the housing and gripper of a projectile in accordance with the invention; and FIG. 7 illustrates a modified projectile housing having apertures for reducing weight in accordance with the invention.

Referring to FIG. 1, the gripper projectile 1 is sized for use in a weaving machine and particularly for picking through a guide formed of a plurality of guide teeth (not shown). The projectile 1 includes a housing 2 and a gripper 3 for gripping a weft yarn 4 at one end.

Referring to FIG. 4*a,* the gripper 3 has a pair of resilient limbs 9, 10 for gripping the weft yarn 4 and a yoke 11 which secures the two limbs 9, 10 together at the opposite end.

The housing 2 is divided in a plane which passes through the limbs 9, 10 of the gripper so as to consist of two halves 5, 6. In addition, means in the form of fasteners, for example rivets 7, 8, pass through the housing 2 and the yoke 11 of the gripper 3 in order to secure the housing halves 5, 6 together while one of the rivets 7 serves to secure the gripper 3 in the housing 2.

Referring to FIG. 4*a,* one housing half 5 is provided with two hollow studs or pins 12, 13 which are aligned and abutted with a similar pair of hollow studs or pins 14, 15 on the other housing half 6. Each aligned pair of studs 12, 14; 13, 15 is sized so as to permit a respective rivet 7, 8 to pass through (see FIG. 2 and 3). In addition, the yoke 11 of the gripper 3 is formed with a bore 16 in which hollow studs 13, 15 are situated after the two housing halves have been brought together.

Of note, after the housing halves 5, 6 are brought together and the rivets 7, 8 introduced into the hollow studs 12–15, riveting may be carried out in any suitable manner.

If only the two rivets 7, 8 were provided to prevent the two halves of the housing 2 from shifting, the shear loading to which the housing halves would be subjected would be considerable in view of the high acceleration and braking forces to which the projectile is subjected during a picking operation in a weaving machine. Accordingly, in order to relieve the rivet of this load, the hollow studs 12, 14 are surrounded by a metal ring such as a steel ring 17. The other rivet 8 is already relieved of load by the yoke 11 of the gripper 3.

Referring to FIGS. 5*a* and 5*b,* instead of using a metal ring about the studs 12, 14 receiving the rivet 7, an oval shaped stud 18 may be formed on one housing half while a mating groove 19 is formed in the other housing half. When brought together, the oval-shaped stud 18 mates in the groove 19 so as to increase the resistence to shear forces between the housing halves. Of note, the oval-shaped stud 18 is elongated in the longitudinal direction of the projectile and both housing halves and stud 18 are provided with suitable apertures for the passage of a rivet (not shown) therethrough.

As shown in FIGS. 4*a* and 4*b,* the two housing halves 5, 6 are recessed internally in a multiplicity of surfaces in order to reduce the weight of the projectile. As indicated, the respective halves 5, 6 are formed with recesses 20–24 on the interior surfaces such that only steps 20′, 21′, 22′, 23′, 24′ remain within the housing halves 5, 6 while only shoulders 25, 26 remain at the hollow studs 12, 13. The resulting reduction in weight is advantageous both with respect to picking of the projectile and braking of the projectile. Further, the housing halves 5, 6 can each be produced by a precision casting or a drop forging method. As indicated in FIG. 1, use of these methods also permit recesses 30, 31 to be formed in the exterior surfaces of the projectile over the entire length of the projectile.

Of note, the provisions of recesses 30, 31 in the wide side walls of the projectile 1 imparts another advantage. That is, only those narrow edges 32, 32'; 33, 33' which are formed at the four edges of the projectile need to contact the guide teeth which serve to guide the projectile across the weaving machine. Thus, lubricating oil which is provided on the projectile within the recess 30, 31 prior to each picking operation cannot be wiped away by the guide teeth. Instead, the film of oil in each recess 30, 31 is maintained until the braking of the projectile. Hence, the wear on the brake linings which are profiled accordingly to the projectile is greatly reduced. Further, the recesses 30, 31 provide better guidance of the projectile in a catcher unit as there is less tendency for the projectile to roll.

Referring to FIG. 7, the weight of a projectile may be further reduced by providing each half 35, 36 of the projectile with a plurality of longitudinally aligned apertures 37.

Referring to FIG. 6, the yoke 40 of a gripper 41 may be provided with an aperture 42 in which a resilient member 43, for example consisting of an elastoner is positioned. In addition, a steel ring 44 is provided inside the resilient member 43 to surround a hollow stud 45 on one housing half and a similar hollow stud on the other housing half (not shown). As above, the ring 44 serves to relieve the rivet (not shown) passing through the hollow stud 45 from shearing forces while the resilient member 43, by being located between the housing and the gripper, serves to damp vibrations from the housing to the gripper. Thus, the risk of a weft yarn being lost by the gripper in the event of a vibration of the projectile over the picking path can be eliminated.

Of note, the fasteners used to secure the housing halves together may be in the form of screws rather than rivets. This permits a defective gripper to be replaced as necessary.

The invention thus provides a projectile which can be made by relatively inexpensive methods. Further, the invention provides a projectile of relatively low weight.

What is claimed is:

1. A gripper projectile for a weaving machine comprising a gripper for gripping weft yarn at one end;

a housing having said gripper mounted therein, said housing being divided in the plane of said gripper; and a hollow stud of oval shape on one housing half and a groove in the other housing half receiving said oval-shaped stud in mating relation.

2. A gripper projectile for a weaving machine comprising a gripper for gripping weft yarn at one end, said gripper including a yoke at an end opposite said one end and a pair of limbs extending from said yoke to said one end, a housing having said gripper mounted therein, said housing including a pair of housing halves divided in the plane of said gripper, each said half having at least one hollow stud facing and abutting a corresponding hollow stud on the other housing half; and means in said abutted hollow studs connecting said housing halves together.

3. A gripper projectile as set forth in claim 2 further comprising a metal ring surrounding said abutted hollow studs.

4. A gripper projectile as set forth in claim 2 which further comprises a hollow stud oval shape on one housing half and a groove in the other housing half received said oval-shaped stud in mating relation.

5. A gripper projectile as set forth in claim 2 further comprising a resilient member between said housing and said gripper.

6. A gripper projectile as set forth in claim 2 wherein said housing halves are recessed in a multiplicity of surfaces thereof.

7. A gripper projectile as set forth in claim 2 wherein said housing has a pair of opposite walls of relatively wide width and a pair of opposite side walls of relatively narrow width, and wherein each wide width wall is recessed.

8. A gripper projectile as set forth in claim 2 wherein said housing has a pair of opposite walls of relatively wide width and a pair of opposite side walls of relatively narrow width, and wherein each wide width wall has a plurality of longitudinally spaced apertures therein.

9. A gripper projectile for a weaving machine comprising a gripper having a pair of resilient limbs for gripping a yarn and a yoke securing said limbs together at one end thereof;

a housing having said gripper mounted therein, said housing being divided in a plane passing through said limbs into a pair of housing halves; and means passing through said housing and said yoke to secure said housing to said gripper, said means including a hollow stud on each respective housing half in aligned abutted relation with a hollow stud on said other housing half and a fastener passing through said aligned studs.

10. A gripper projectile as set forth in claim 9 wherein said means includes a pair of rivets.

11. A gripper projectile as set forth in claim 9 wherein said fastener is a rivet.

12. A gripper projectile as set forth in claim 9 which further comprises a metal ring surrounding said aligned studs.

13. A gripper projectile as set forth in claim 9 wherein said means further includes a pair of said hollow studs on each housing half in aligned abutted relation with a pair of said studs on the other housing half and a pair of said fasteners, each said fastener passing through a respective pair of aligned studs.

14. A gripper projectile as set forth in claim 9 wherein said means further includes a stud of oval shape on one housing half and a groove in the other housing half receiving said oval-shaped stud in mating relation.

15. A gripper projectile as set forth in claim 15 wherein said means further includes a fastener passing through said oval-shaped stud and mating groove to secure said housing halves together.

16. A gripper projectile as set forth in claim 9 which further comprises a resilient member about said aligned studs between said gripper and said housing for damping vibrations of of said housing to said gripper.

17. A gripper projectile as set forth in claim 9 wherein said housing is recessed and apertured to effect a weight reduction.

18. A gripper projectile for a weaving machine comprising a gripper for gripping weft yarn at one end, said gripper including a yoke at an end opposite said one end and a pair of limbs extending from said yoke to said one end;

a housing having said gripper mounted therein, said housing including a pair of housing halves divided in the plane of said gripper, each said half having at least one hollow stud facing and abutting a corresponding hollow stud on the other housing half, said studs passing through said yoke of said gripper; and means in said abutted hollow studs connecting said housing halves together.

19. A gripper projectile as set forth in claim 18 which further comprises a second hollow stud on each housing half facing and abutting each other between said limbs and a hollow metal ring surrounding said second hollow studs.

* * * * *